United States Patent [19]

Ohtawa et al.

[11] 4,412,674

[45] Nov. 1, 1983

[54] HIGH-TEMPERATURE REDUCED IRON PRODUCTION

[75] Inventors: Kimiaki Ohtawa; Hiroyoshi Takahashi; Yasuo Fukada, all of Hiroshima, Japan

[73] Assignee: Mitsubishi Jukogyo Kabushiki Kaisha, Tokyo, Japan

[21] Appl. No.: 252,603

[22] Filed: Apr. 9, 1981

[30] Foreign Application Priority Data

May 9, 1980 [JP] Japan ..... 55-60739
May 14, 1980 [JP] Japan ..... 55-62782

[51] Int. Cl.[3] ..... C21D 11/00
[52] U.S. Cl. ..... 266/91; 266/176
[58] Field of Search ..... 266/91, 99, 208, 216; 75/53, 58; 209/606, 659

[56] References Cited

U.S. PATENT DOCUMENTS 3,260,591 7/1966 Brown ..... 75/53
3,345,055 10/1967 Kutscher ..... 75/53
3,666,449 5/1972 Alt ..... 266/216
3,944,195 3/1976 Buell ..... 266/216

*Primary Examiner*—P. D. Rosenberg
*Attorney, Agent, or Firm*—Wenderoth, Lind & Ponack

[57] ABSTRACT

A reduced iron installation includes transportable container having a charge/discharge mouth section provided with a sealing valve and a plurality of support legs and is arranged for 180° rotation between a charge condition under a furnace to a discharge condition supported over the mouth of a storage tank via its legs, a weighing device for said container in its discharge condition, and a cluster remover disposed in the storage tank mouth and having a sealing valve which opens and closes, in response to detection signals from the weighing device indicating that the container is charged or empty, respectively. The cluster remover includes a grizzly feeder disposed obliquely within a cylindrical casing which is supported via an anti-vibration mounting on a fixed support surface, and a vibrating machine mounted on the casing.

7 Claims, 4 Drawing Figures

HIGH-TEMPERATURE REDUCED IRON PRODUCTION

BACKGROUND OF THE INVENTION

The present invention relates to high-temperature reduced iron production in which there is provided either a hot charging installation for charging granular reduced iron produced by a reduction furnace directly into a steel making furnace, or a storage tank for the reduced iron remote from the reduction furnace, and briquetting plant associated with the storage tank.

Heretofore, in the case of briquetting high-temperature reduced iron, the briquetting plant has been directly coupled to the reduction furnace through a connecting pipe. However, since the briquetting plant must be installed under the reduction furnace there is a disadvantage that the overall height of the furnace is extremely high.

SUMMARY OF THE INVENTION

An object of the invention is to eliminate the above-described disadvantage in the prior art by providing a high-temperature reduced iron installation in which the briquetting plant is remote from the furnace and granular reduced iron is transported from the furnace to the plant via a transportable container in an efficient manner.

Another object of the invention is to provide effective means for removing clusters contained in the high-temperature reduced iron.

According to one aspect of the invention, a high-temperature reduced iron installation is characterized in that such installation includes a transportable container for transporting granular reduced iron produced in a furnace to a storage tank remote from the furnace. The container includes a mouth defining a charge/discharge section provided with an opening and closing valve which preserves fluid-tightness when closed and a plurality of support legs. The container is arranged for rotation through 180° between a charge condition with its mouth uppermost for receiving reduced iron from the furnace and to a discharge condition with its mouth lowermost and adapted to be supported over a mouth of the storage tank via the support legs. A weighing device is arranged to be interposed between the container and the storage tank when the container is in its discharge condition. A cluster remover includes means for fluid-tight connection to the mouth of the container in the discharge position, the cluster remover being disposed in the mouth of the storage tank and being provided with a sealing valve which is adapted to be opened and closed, respectively, in response to detection signals from the weighing device indicating that the container is charged or empty.

According to a second aspect of the invention a cluster remover for removing clusters formed in the course of producing high-temperature reduced iron is characterised in that a grizzly feeder is disposed obliquely within a cylindrical casing, through which the reduced iron is fed from a reduction furnace, the cylindrical casing being supported via an anti-vibration mounting on a fixed support surface, and in that a vibrating machine is mounted on the casing and is operable to vibrate the grizzly feeder with respect to the fixed support surface. When the cluster remover is to be used in a high temperature reduced iron installation according to the first aspect of this invention, the cylindrical casing with the grizzly feeder disposed therein is provided within the mouth of the storage tank for receiving the high-temperature reduced iron and is connected to the storage tank via an expansion joint, and a freely openable hatch for discharging clusters separated from the reduced iron is provided on the casing adjacent the lower end of the grizzly feeder, and also a cluster discharging chute is provided adjacent the hatch.

BRIEF DESCRIPTION OF THE DRAWING

In the following, the present invention will be described in greater detail in connection with a preferred embodiment thereof with reference to the accompanying drawings, in which.

DETAILED DESCRIPTION OF THE DRAWING

Figure 1:
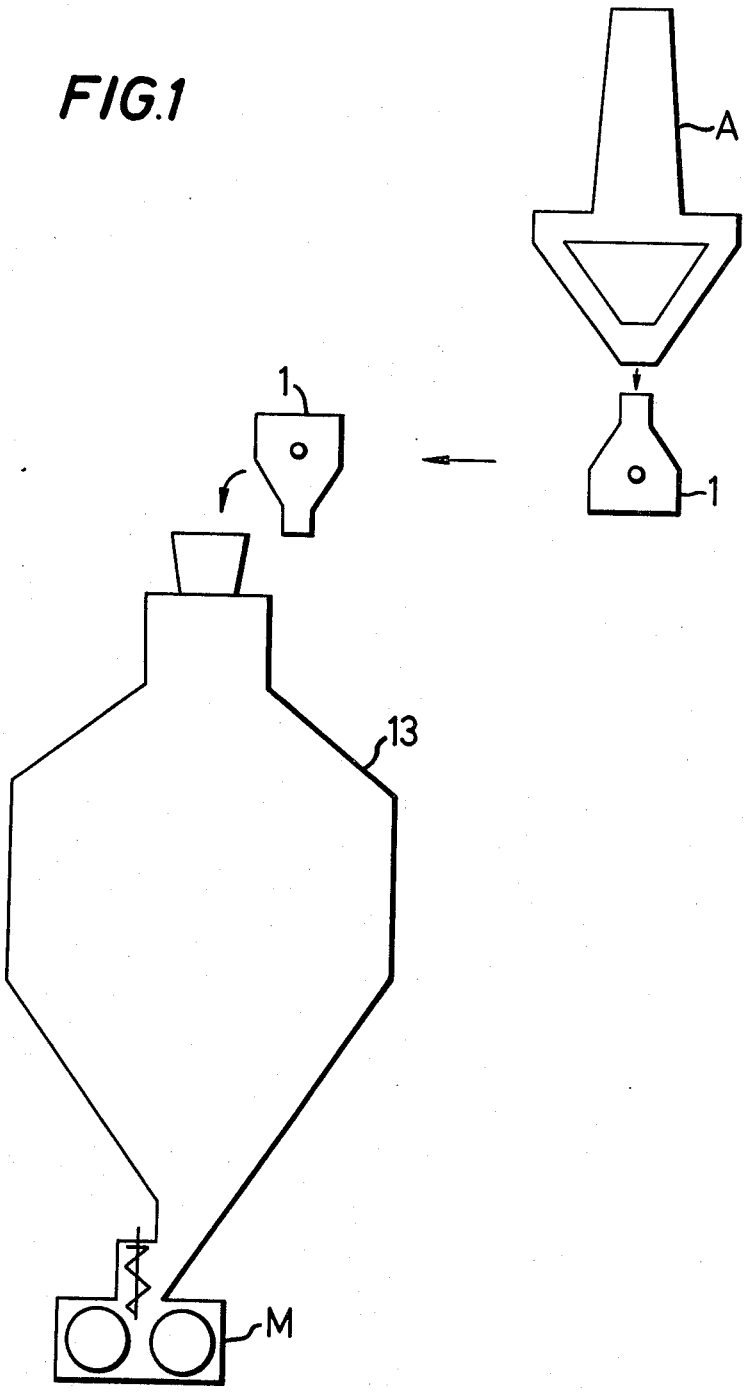
FIG. 1 is a conceptional flow diagram of a hot briquetting installation of the type having a transportable container for transporting granular reduced iron from a furnace to a briquetting plant.

Referring to FIG. 1, reference character A designates a reduction furnace, and numeral 1 designates a transportable container for transporting and charging high-temperature granular reduced iron produced by the reduction furnace A to the interior of a high-temperature reduced iron storage tank 13 of a briquetting plant installed at a location remote from the reduction furnace A and provided with a briquetting machine M thereunder.

Figure 2:
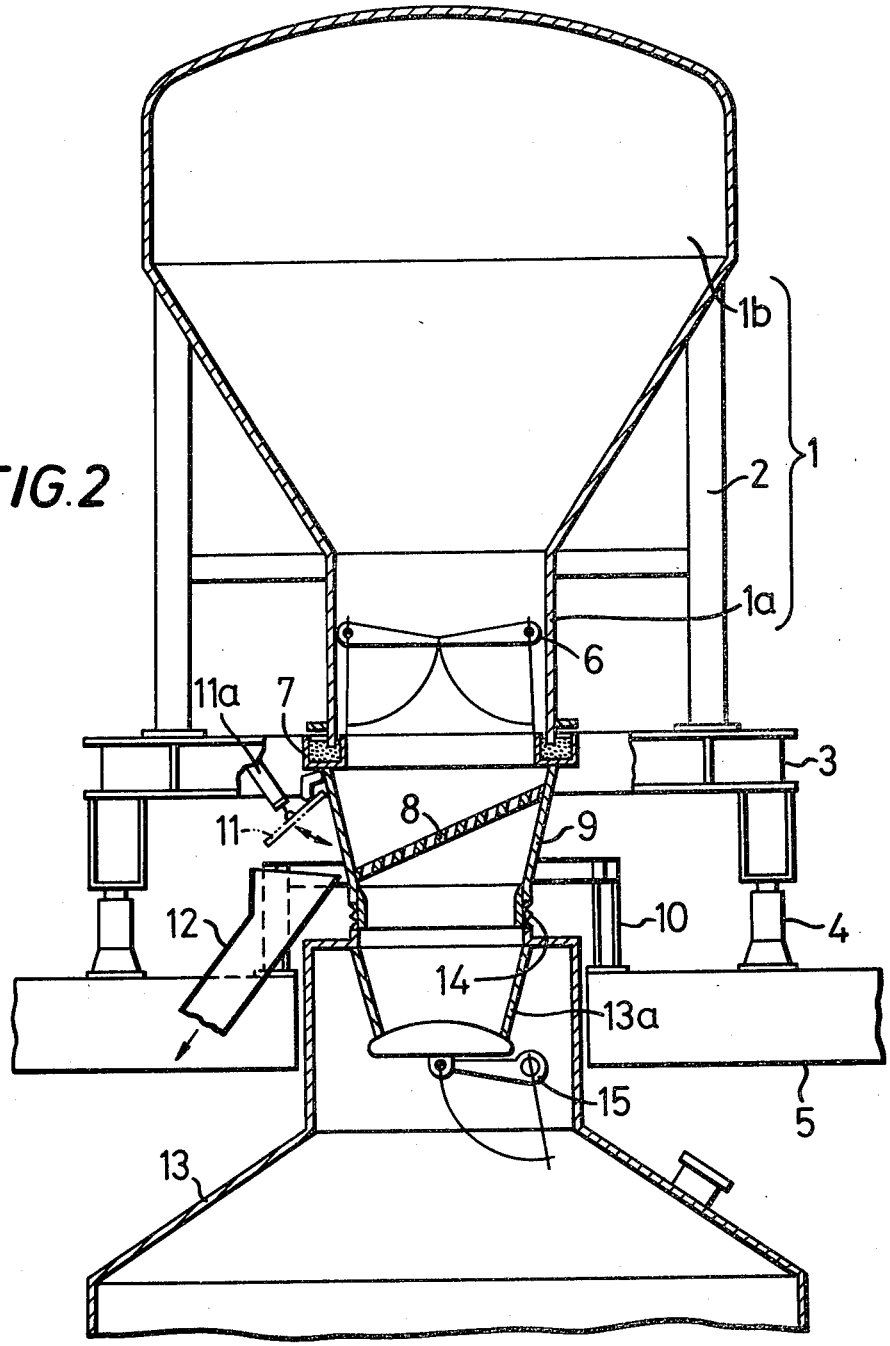
FIG. 2 is a longitudinal cross sectional view of the transportable container shown connected to the charge end of a storage tank of the briquetting plant.

Referring now to FIG. 2, in the preferred embodiment of the invention, the transportable container 1 comprises a reduced iron charge/discharge section 1*a* provided with a double-door type valve 6, a reduced iron storage section 1*b* and a plurality of support legs 2. After charging the container 1 with high-temperature reduced iron from the reduction furnace A, through the reduced iron charge/discharge section 1*a* (i.e. with the container mouth uppermost and the valve 6 open) and into the reduced iron storage section 1*b* under the condition shown on the right hand side of FIG. 1, the valve 6 is closed and made fluid-tight, the container 1 is transported by a crane or other suitable equipment to the briquetting plant, rotated through 180° and located on a support surface 3 of the storage tank 13 via the support legs 2. The support surface 3, is, in turn, supported from a fixed equipment deck 5, via a weighing device 4. Between the support surface 3 and the mouth of the storage tank 13 there is provided a cluster remover 9 of annular form, which is supported from the equipment deck 5 via a support frame 10 and provided with an inclined grizzly feeder 8 as described in more detail hereinafter with reference to FIGS. 3*a* and 3*b*. The upper opening of the cluster remover 9 has an annular channel or groove 7, which is filled sand or like deformable material, so that when the container 1 is lowered onto the support surface 3 via its support legs 2 as described above, the rim of the mouth of the reduced iron charge/discharge section 1*a* of the container 1 sinks into the sand and, thereby, is connected to the cluster remover in a fluid-tight manner. A hatch 11 is mounted at an appropriate location on the side wall of the cluster remover 9 adjacent the lower end of the inclined grizzly feeder 8 so as to be freely opened and closed by the actuation of appropriate drive means such as, for example, a hydraulic cylinder 11*a*, and a cluster discharge chute 12 for discharging clusters (i.e. sintered blocks of reduced iron of approximately 10–30 cm in diameter, which tend to be formed in the course of production of the reduced iron) separated from high-temperature reduced iron by the grizzly feeder 8 in the cluster remover 9 is mounted adjacent the hatch 11. The bottom opening of the cluster remover 9 is fluid-tightly connected to a hopper-like section 13*a* provided in the mouth of the storage tank 13 via an expansion joint 14. A damper type sealing valve 15 is provided, as shown in FIG. 2, to open and close the bottom opening of the hopper-like section 13*a*. The sealing valve 15 can be controlled by any appropriate control means (not shown) which are operable to open valve 15 in response to a detection signal from the weighing device 4 when the container 1 charged with reduced iron is set down on the support surface 3 as shown in FIG. 2. The valve 15 is closed by the control means in response to a signal from the weighing device 4 when the container 1 has been emptied.

After the container 1 has been emptied, and the valve 15 closed in response to a signal from the weighing device 4, the hatch 11 is opened by actuating its hydraulic cylinder 11*a*, and the clusters separated by the grizzly feeder 8 are discharged through the discharge chute 12. Subsequently, after closing the double-door type valve 6 in the container 1, the container 1 is once more rotated back through 180° and transported back to its charging location beneath the reduction furnace A to be ready for receiving the next batch of high-temperature reduced iron.

The high-temperature reduced iron from which the clusters have been removed, and which has been charged into the storage tank 13, as described above, is briquetted by the briquetting machine M (see FIG. 1) disposed under the storage tank 13, and thereafter the shaped briquettes are removed.

Figure 3A:
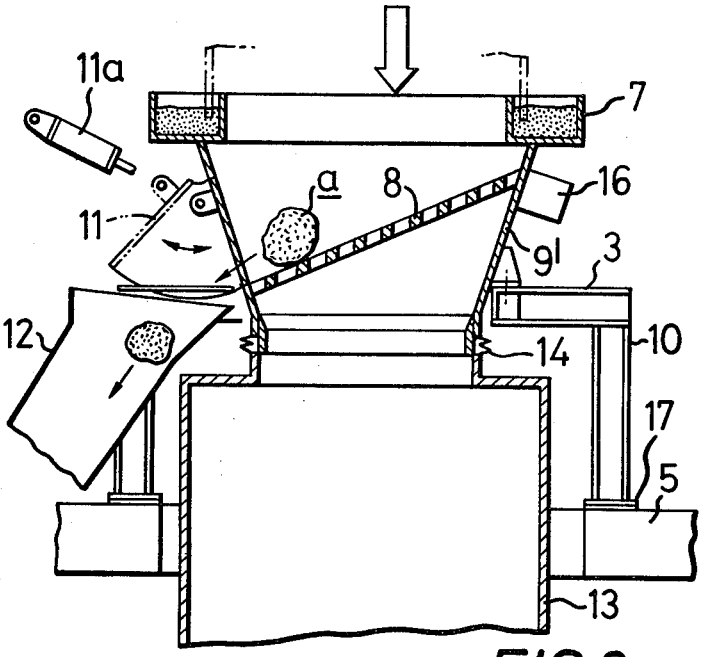
FIG. 3*a* is a view similar to FIG. 2 of the charge end of the storage tank of the briquetting plant, showing further details of a cluster remover disposed therein.
Figure 3B:
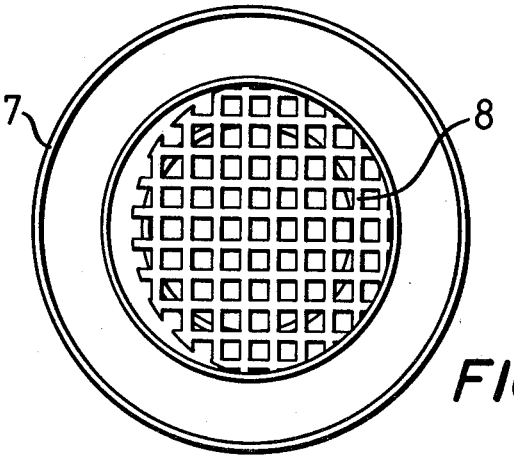
FIG. 3*b* is a plan view of the apparatus of FIG. 3*a*.

Referring now to FIGS. 3*a* and 3*b*, in more detail, the grizzly feeder 8 is lattice or grate shaped and its mesh is selected so that normal granular reduced iron supplied from the container (as shown by the arrow) can easily pass therethrough. The cylindrical casing 9' of the cluster remover 9 for supporting the grizzly feeder is fixedly secured to the support frame 3, which in tern is, fixed via the support frame 10 and an anti-vibration rubber piece 17 to the equipment deck 5 of the storage tank 13. The casing 9' itself is connected at its lower open end to the storage tank 13 via expansion joint 14 as described hereinbefore.

Again, as described hereinbefore, the casing 9' is provided with a hatch cover 11, which can be freely opened and closed by means of a hydraulic cylinder 11*a* and a discharge chute 12 beneath and adjacent hatch cover 11.

In addition, on the casing 9' is mounted an electromagnetic type or mechanical type of vibrating machine 16, the mounting position for which can be selected arbitrarily at any point around the circumference of the casing.

In use, granular reduced iron transported by the container 1, (or in the case of a hot charging installation, directly from the reduction furnace) passes through the grizzly feeder 8, and into the storage tank 13 which can be kept air-tight by the sealing valve 15 described hereinbefore. Clusters a contained in the reduced iron, which would be a hindrence to the manufacture of briquettes should they be thrown into the storage tank 13, remain on the grizzly feeder 8, and when the hatch cover 11 is opened by the cylinder 11*a*, they are discharged through the discharge chute 12. Separation between the granular reduced iron and the clusters can thus be effected efficiently by means of the vibrating machine 16. However, the vibration of the casing 9' is damped by the anti-vibration rubber piece provided, and thus propagation of the vibration to the storage tank 13 is prevented by the expansion joint 14.

Since both the high-temperature reduced iron installation and the cluster remover therefor, according to the present invention, have the above mentioned constructions and effects, the present invention can provide advantages over the prior art as discussed hereinbefore, and moreover, the present invention can achieve the practical effect that high-temperature granular reduced iron free from clusters can be obtained under perfect conditions, since it is isolated from external, ambient conditions. Consequently, hot briquettes of excellent quality can be obtained.

It will be appreciated from the foregoing that, particularly with regard to the cluster remover, the present invention is also applicable to a hot charging installation in which high-temperature reduced iron is continuously charged directly to an electric furnace.

It will also be appreciated that by providing an inclined grizzly feeder within the cluster remover as described above and providing vibrating means externally on its casing, reduced iron can pass efficiently through the casing and it is not blocked by clusters on the grizzly feeder, since they gravitate to the lower end of the feeder. Thereby, the clusters can be removed at a high efficiency via the discharge chute 12.

We claim:

1. An installation for transferring high temperature granular reduced iron from a furnace to a storage tank located at a position remote from said furance, said installation comprising:

a transportable container having an inner chamber and a charge/discharge section defining an opening extending into said inner chamber, said container being arranged for rotation through 180° between a charge position, whereat said charge/discharge section and said opening are directed upwardly to receive reduced iron from the furnace, and a discharge position, whereat said charge/discharge section and said opening are directed downwardly to discharge reduced iron from said container into the storage tank;

said container including leg means for supporting said container in said discharge position thereof;

valve means for selectively unblocking said opening during charging and discharging therethrough and sealingly closing said opening during movement of said container between said charge and discharge positions thereof;

a cluster remover adapted to be positioned within a mouth of the storage tank, said cluster remover having means for forming a fluid-tight seal with said charge/discharge section of said container when said container is in said discharge position, and said cluster remover having a passage through which passes the reduced iron during discharge thereof from said container into the storage tank;

weighing means, adapted to be interposed between said container and the storage tank when said container is in said discharge position, for determining whether or not the reduced iron in said container has been discharged into the storage tank and for generating detection signals representative thereof; and sealing valve means, provided on said cluster remover and operable in response to said detection signals from said weighing means, for unblocking said passage of said cluster remover when said container is charged with reduced iron and for sealingly closing said passage of said cluster remover when the reduced iron has been discharged from said container.

2. An installation as claimed in claim 1, wherein said cluster remover comprises a generally cylindrical casing defining said passage and adapted to extend into the mouth of the storage tank, and said sealing valve means is positioned at the bottom of said casing.

3. An installation as claimed in claim 2, wherein said seal forming means comprises an annular channel on an upper portion of said casing, said channel being filled with a deformable material into which extends said charge/discharge section of said container when said container is in said discharge position.

4. An installation as claimed in claim 2, wherein said cluster remover further comprises a feeder member positioned within said casing in the path of reduced iron passing therethrough from said container to the storage tank, said feeder member having therethrough openings of a size to pass normal reduced iron but to block the passage of oversized clusters of reduced iron.

5. An installation as claimed in claim 4, wherein said feeder member is inclined to the horizontal, and further comprising a selectively openable hatch in said casing adjacent the lower end of said inclined feeder member, whereby clusters retained on said feeder member may be discharged to the exterior of said casing.

6. An installation as claimed in claim 1, further comprising expansion joint means for connecting said casing to the mouth of the storage tank.

7. An installation as claimed in claim 1, wherein said casing includes anti-vibration mounting means, and further comprising a vibrator connected to said casing.

* * * * *